United States Patent [19]

Malott

[11] 4,080,083

[45] Mar. 21, 1978

[54] CONNECTORS FOR ROOF RIDGE VENTILATOR

[75] Inventor: Richard C. Malott, Spring Lake, Mich.

[73] Assignee: Leigh Products, Inc., Coopersville, Mich.

[21] Appl. No.: 757,970

[22] Filed: Jan. 10, 1977

Related U.S. Application Data

[63] Continuation-in-part of Ser. No. 597,036, Jul. 18, 1975.

[51] Int. Cl.[2] ..... E04D 13/16

[52] U.S. Cl. ..... 403/305; 98/42 A; 52/199

[58] Field of Search ..... 403/309, 313, 305; 52/199, 300, 726; 98/42.1; 285/398, 371, 423, 424

[56] References Cited

U.S. PATENT DOCUMENTS

| | | | |
|---|---|---|---|
| 522,363 | 7/1894 | Davis | 52/300 |
| 1,450,826 | 4/1923 | Walten | 285/424 |
| 2,855,776 | 10/1958 | Trostle | 52/300 |
| 3,073,235 | 1/1963 | Smith et al. | 98/42.1 |
| 3,303,773 | 2/1967 | Smith et al. | 98/42.1 |
| 3,326,113 | 6/1967 | Smith et al. | 98/42.1 |
| 3,512,805 | 5/1970 | Glatz | 285/424 |
| 3,545,144 | 12/1970 | Sickler | 52/11 |
| 3,798,853 | 3/1974 | Castle | 52/300 |

FOREIGN PATENT DOCUMENTS

| | | | |
|---|---|---|---|
| 1,361,391 | 7/1974 | United Kingdom | 52/726 |

*Primary Examiner*—Andrew V. Kundrat
*Attorney, Agent, or Firm*—Price, Heneveld, Huizenga & Cooper

[57] ABSTRACT

Connectors are provided to connect adjacent roof ridge ventilator sections. The connectors include a cutout, intermediate wall, an outer jacket and an inner sleeve defining slot to receive the ends of adjacent ventilator sections.

17 Claims, 17 Drawing Figures

CONNECTORS FOR ROOF RIDGE VENTILATOR

CROSS REFERENCE TO RELATED APPLICATION

This application is a continuation-in-part of earlier filed, copending application, Ser. No. 597,036, filed July 18, 1975 and entitled END CAP AND CONNECTORS FOR ROOF RIDGE VENTILATOR. This application is also related to copending application, Ser. No. 726,203, filed Sept. 24, 1976 which is a divisional application of the aforementioned application, Ser. No. 597,036.

BACKGROUND OF THE INVENTION

This invention relates to roof ridge ventilator assemblies and, more particularly, it concerns improved end caps and connectors for such assemblies.

Natural attic ventilation systems generally include an eaves ventilator and a roof ridge ventilator, both of which extend longitudinally the length of the building. Such systems function to remove warm air from an attic space during the summer months to cool the attic eliminating the necessity for or reducing air conditioning loads. During the winter months, such ventilation systems serve to remove moisture from the attic space to prevent soaking and deterioration of the ceiling insulation material. The roof ridge ventilator assemblies must be compact and aesthetically pleasing and still be capable of withstanding exposure to high winds, rain, snow, sunlight and various forms of air pollution. Preferably, they should have a low silhouette.

Ridge ventilation assemblies generally take the form of somewhat T-shaped hooded sections joined together and extending longitudinally along the ridge of a roof. The ends of the ventilator assembly are closed by cap-like elements.

SUMMARY OF THE INVENTION

In accordance with the present invention, improved roof ridge ventilator connector or joiner elements are provided resulting in communication between adjacent ventilator sections, waterproof joints without the necessity of external cover elements, and the ability to permit ready adaptation of a roof ridge ventilator assembly to roofs of different pitches. Essentially, a joiner or connector is provided having a cutout, intermediate wall shaped so as to conform with the cross section of a roof ridge ventilator section, a peripherally extending outer jacket and an inner sleeve spaced from the outer jacket and defining therebetween a slot extending around a major portion of the cutout wall and adapted to receive the ends of adjacent roof ridge vent sections. An upstanding inner jacket and an angled depending flashing portion are adapted to receive the inner sidewalls and flashing portions of adjacent roof ridge vent sections.

DETAILED DESCRIPTION OF THE PREFERRED EMBODIMENTS

Figure 1:
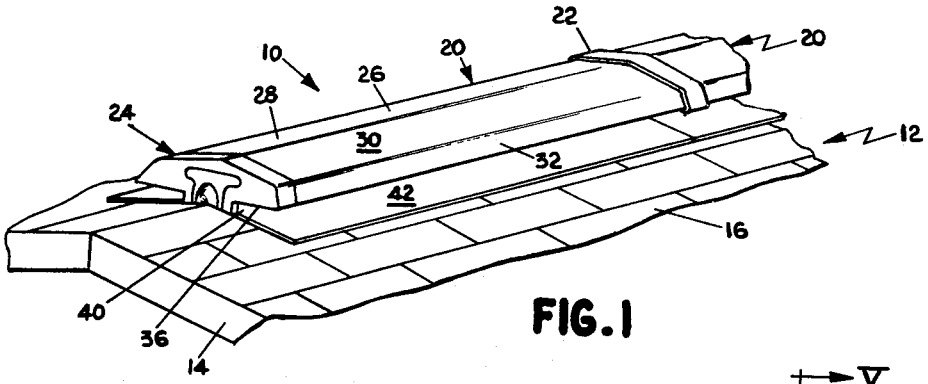
FIG. 1 is a fragmentary perspective view illustrating a roof ridge ventilator assembly including an improved end cap and the connector elements of the subject invention.

With reference to the drawings, FIG. 1 illustrates a roof ridge vent assembly generally designated 10 mounted on the top of the ridge of a roof 12. The roof structure is conventional and includes rafters 14 and sheathing boards (not shown) covered by shingles 16. The ridge vent assembly includes a plurality of longitudinally extending vent sections 20. Each section 20 is connected by a connector or joiner 22 and the ends of the ridge vent assembly are closed by end caps 24.

Figure 3:
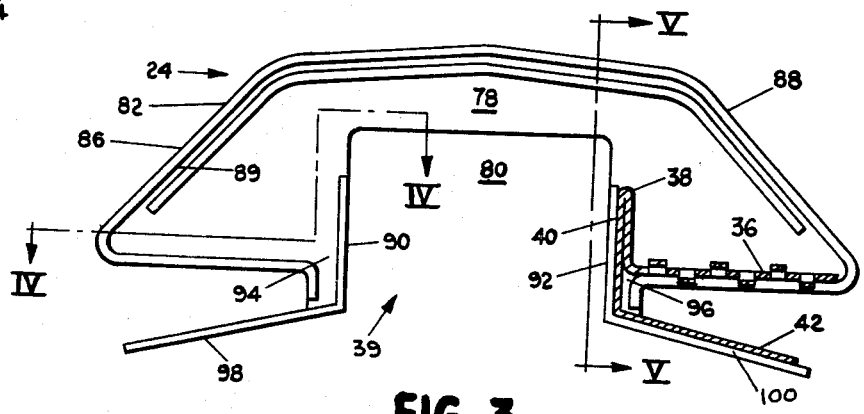
FIG. 3 is a front elevation of a connector element in accordance with the subject invention including a fragmentary portion of a roof ridge ventilator section.

Each vent section 20, as more fully described in copending, commonly owned application, Ser. No. 597,029, entitled VENTILATOR FOR ROOF RIDGE, filed July 18, 1975 by the present inventor, has a hood 26 including depending top portions 28 and 30 and outer sidewalls 32. The outer sidewalls are integral with inwardly extending, horizontally positioned panels 36, as best seen in FIG. 3, and an upwardly extending dam portion 38 (FIG. 3). Downwardly extending inner walls 40 defining the ventilating throat 39 are integral with outwardly extending downwardly angled flashing portions 42.

Figure 6:
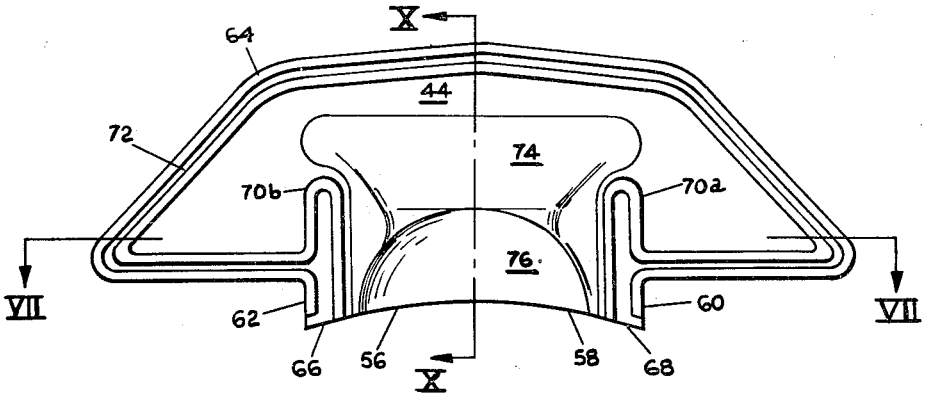
FIG. 6 is a rear elevation of the end cap.
Figure 8:
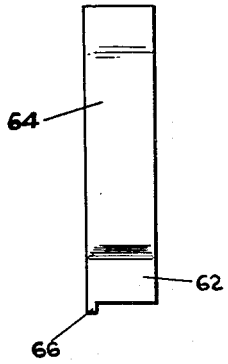
FIG. 8 is a side elevation view of the end cap of FIG. 6.

Referring to FIGS. 2, 6, 7 and 8, the end cap 24 includes a wall having a main portion 44 and a depending leg portion 46. The main wall portion 44 conforms to the general cross-sectional silhouette of the ridge ventilator sections 20 and includes top edges 48 and 50 depending side edges 52 and 54, inwardly extending bottom edges 56 and 58 and depending leg edges 60 and 62. As seen in FIG. 6, an inwardly directed outer jacket or outer peripheral flange 64 extends around the outer peripheral edge of the end cap 24. The outer jacket 64 extends in a longitudinal direction with respect to a ridge vent section 20, peripherally of the cap and terminates just short of the lower edge of leg portions 60 and 62 to define with the leg portions depending tabs 66 and 68 (FIG. 6). An inner flange or sleeve 70 is spaced from the outer jacket 64 and extends parallel to the jacket adjacent the periphery of the main wall portion 44 of the end cap 24.

At the end of the bottom edge portions 56 and 58, the inner sleeve 70 has vertical U-shaped portions 70*a* and 70*b* with the inner leg extending downwardly to the lower edge of the depending leg wall portion 46 (FIG. 6). The outer jacket 64 in conjunction with the inner flange or sleeve 70 define a channel 72 within which the end of the ridge vent sections 20 may be slidably received. The U-shaped portions 70*a* and 70*b* provide pockets for receiving the upstanding dams or baffles 38 (FIG. 3) of the ventilator. The tabs 66 and 68 of the end caps 24 provide clearance for the flashing portions of the ridge ventilator sections and serve to prevent moisture from entering the interior of the ventilator sections.

Figure 2:
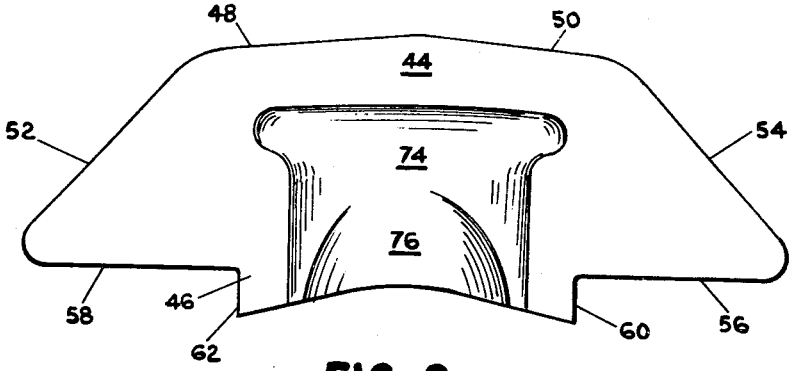
FIG. 2 is a front elevation of the end cap.
Figure 10:
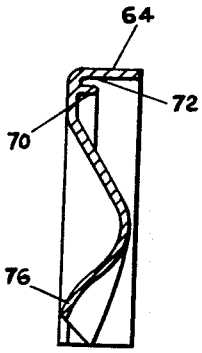
FIGS. 10 and 11 are cross-sectional views taken along line X—X of FIG. 6 depicting the deflection of the wall of the end cap in accordance with the subject invention as the end cap conforms to roofs of different pitches.
Figure 11:
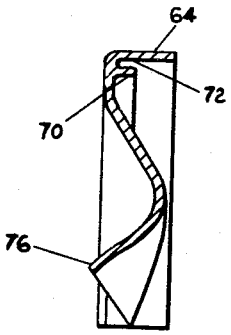
Figure 9:
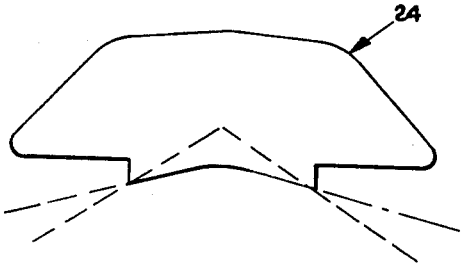
FIG. 9 is a view of the end cap schematically illustrating a range of roof pitch variation.
Figure 7:
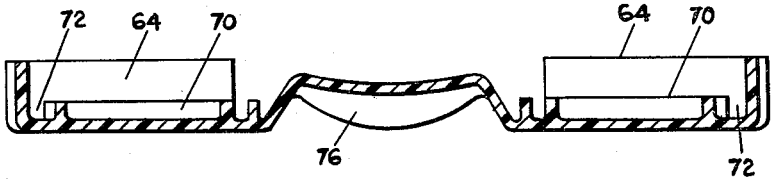
FIG. 7 is a cross-sectional view taken along line VII—VII of FIG. 6.

As best seen in FIGS. 2, 6 and 7, the central area of the main wall portion 44 includes a depression 74, i.e., a generally concave area with respect to the exterior of the cap, which area is somewhat T-shaped and extends generally downwardly and terminates in an outwardly directed bulge 76. This structural arrangement results in an end cap having a deflectable wall which readily conforms to different pitched roofs without distorting the remaining body of the end cap. The excess wall length created by the depression or concavity 74 provides an excess of material and a readily manipulated hinge which permits substantial deformation of this center wall without creation of tension and compression stresses in the remaining portions of the end cap which will distort the entire cap (FIGS. 10 and 11). Thus, the cap can be adjusted to accommodate a substantial range of roof pitches without such distortion that it cannot be readily slipped over the end of the ventilator.

Figure 4:
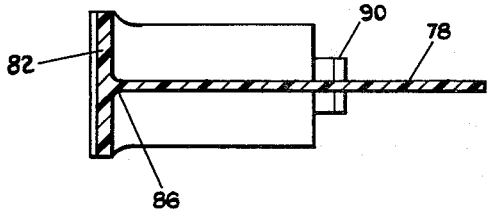
FIG. 4 is a cross-sectional view taken along line IV—IV of FIG. 3.
Figure 5:
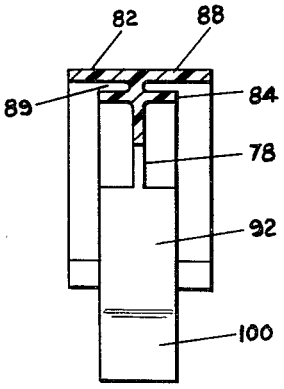
FIG. 5 is a cross-sectional view taken along line V—V of FIG. 3.

As best seen in FIGS. 3, 4 and 5, the connectors 22 in accordance with the present invention, include an intermediate web-like wall 78 having a cutout or opening 80 formed therein. As a result, the central top portion of wall 78 serves as a flexible bridge as more fully explained below. An outer connector flange or joiner jacket 82 extends around the periphery of the wall 78. The outer jacket is basically a rim or skirt centered about the web 78 whereby it extends equally from each side of the web. An inwardly spaced, inner connector flange or sleeve 84 extends from both sides or faces of the wall 78, in parallel spaced relationship to the outer skirt or jacket 82. The inner sleeve is shorter and terminates intermediate the ends of the outer edge portions 86 and 88 (FIG. 3) of wall 78 to define slots 89. The joiners 22 further include inner jackets 90 and 92 extending vertically along the inner edge of leg portions 94 and 96 of the intermediate wall 78. The inner jackets 90 and 92 (FIG. 3) and lower legs 94 and 96 of the wall 78 are integral with outwardly and downwardly extending flashing tabs 98 and 100.

As best seen in FIGS. 1 and 3, the outer surface of the end of each ventilator section 20 is covered by the outer jacket 82 while the flashing portions 42 of the ventilator are disposed on top of the flashing tabs or legs 98 and 100. The overall arrangement permits the connector sections to engage the ends of adjacent ventilator sections 20 in a waterproof manner.

The end caps 24 and connectors 22 are preferably formed from a resilient, deflectable plastic or rubber material such as ethylene acrylate or ethylene vinyl acetate.

Due to the existence of the cutout portions 80 in the walls or webs 78, each connector is capable of flexing about the bridge portions without significant distortion of the slots 89 as the ridge vent sections are fitted to the roof, thereby insuring an adequate waterproof joint between adjacent sections. Further, due to the shape of the deflectable wall of the end caps 24, each end cap is capable of flexing without significant distortion at the channel 72 to thereby effectively maintain a capping seal with the ends of the roof ridge ventilator assembly. This can be best seen in FIGS. 10 and 11. FIG. 11 illustrates the attitude taken by the deflectable wall including the bulge 76 when the end cap is deflected to fit a roof having a greater pitch than that shown in FIG. 10.

Figure 13:
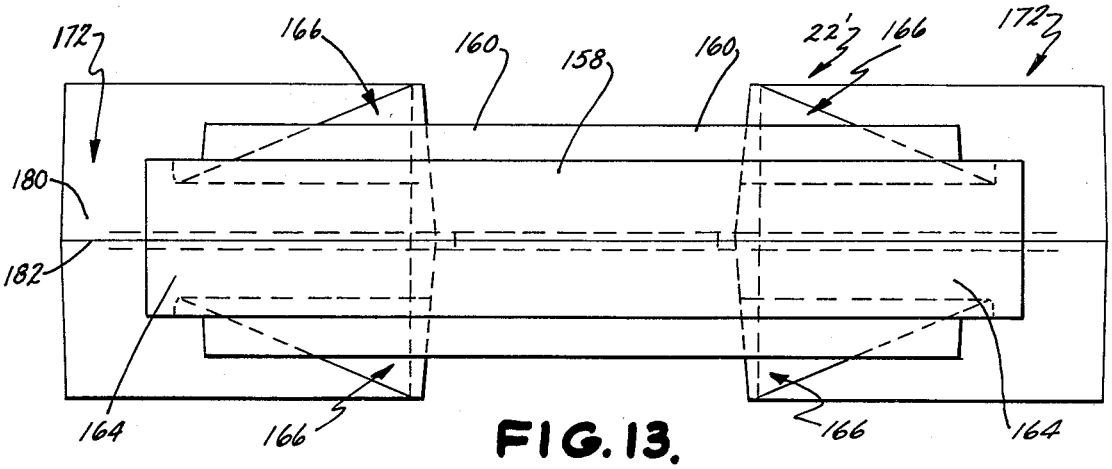
FIG. 13 is a top plan view of the connector of FIG. 12.
Figure 15:
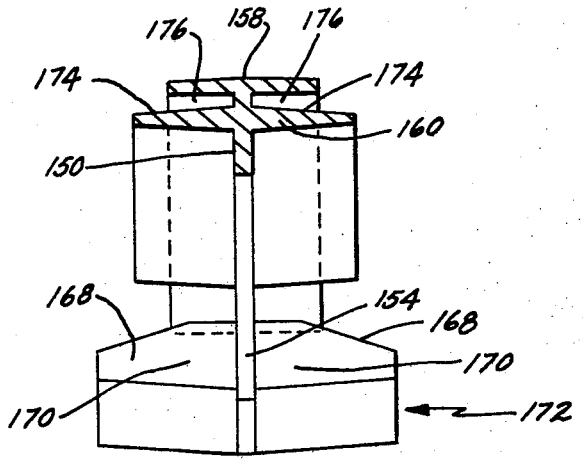
FIG. 15 is a cross-sectional view taken along line XV—XV of FIG. 12.
Figure 16:
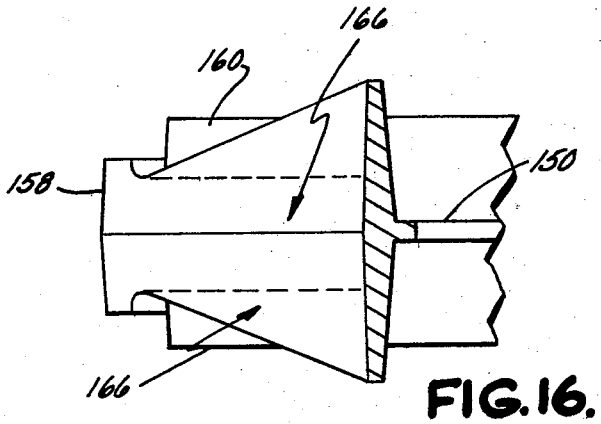
FIG. 16 is a cross-sectional view taken along line XVI—XVI of FIG. 12.

An alternative form, generally designated 22', for the connector is illustrated in FIGS. 13–17. As shown therein, the alternative which is the presently preferred embodiment for the connector, similarly includes a central web or intermediate wall portion 150 having a generally T-shape in vertical elevation. The central portion of the web is cut away to define an opening 152. As a result, the intermediate wall 150 includes an upper central portion having the same general configuration as the cross section of a ventilator section and a pair of depending leg portions 154, 156. Extending around the outer periphery of the intermediate wall 150 is a connector flange or a joiner 158. Spaced inwardly from and extending parallel to the flange 158 along a portion thereof is an inner connector flange, sleeve or joiner jacket 160. As best seen in FIGS. 13 and 15, the outer connector flange 158 is positioned centrally of and therefore extends outwardly an equal amount from each side of the intermediate wall 150 and longitudinally to a ventilator section as it extends around the hood portion of the connector. The outer connector flange 158 therefore includes a peaked top portion 162 and sidewall portions 164. As the flange 158 extends inwardly from the sidewall portions towards the cutout 152, it flares outwardly so as to define generally triangular portions 166, when viewed in plan. Each triangular portion 166 includes a top surface 168 which is beveled downwardly and transversely of the intermediate wall in order to increase the ease with which the connector and ventilator sections may be assembled.

The outer connector flange 158 extends downwardly along the depending legs 154, 156 to define inner jacket portions 170. Integral with the inner jacket portions 170 and extending downwardly and outwardly are flashing portions 172. The inner jacket portions are spaced from the inner lateral edges of the leg portions.

The inner connector flange or sleeve 160, as best seen in FIGS. 13 and 15, also extends outwardly from the intermediate wall 150 an equal distance from each side thereof. In this form of the connector, the inner flange 160 has a transverse width dimension greater than that of the outer flange 158. Further, the upper surface 174 of the inner flange 160 is beveled downwardly from the wall to the lateral edge of the sleeve on each side of the wall (FIG. 15). As a result of this arrangement, the intermediate wall 150, the outer connector flange 158 and the inner connector flange 160 define a pair of outwardly opening slots 176 positioned at each side of the intermediate wall 150. Each slot 176 has a gradually increasing opening outwardly from the intermediate wall. This increases the ease by which the hooded portion of the ventilator section could be received within the slots 176.

Figure 17:
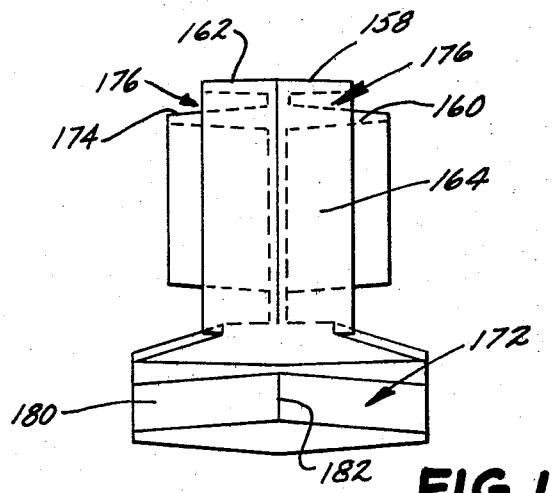
FIG. 17 is an end elevational view of the connector of FIG. 12.

The upper surface 180 of each flashing tab or portion 172 is tapered from a central peak 182 downwardly and outwardly towards the lateral edges of the tabs. The undersurface 183 of each flashing tab 172 is beveled or tapered outwardly and upwardly toward the lateral edges thereof. As a result, and as best seen in FIG. 17, the cross-sectional shape of the tab portions could be described as a pair of opposed, generally V-shaped sections increasing in thickness from the lateral edges towards the center of the tabs. Extending longitudinally of the tabs 172 along the undersurface thereof is a sealing rib 190. Each sealing rib 190 is in effect an integral, extension of the depending legs 154, 156 of the intermediate wall 150.

Figure 12:
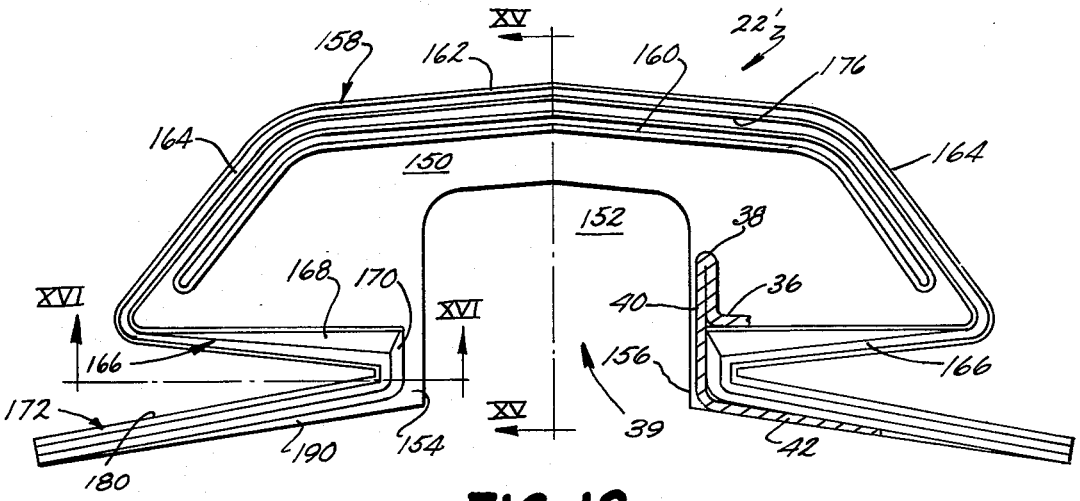
FIG. 12 is a front elevation of another embodiment of the connector element.
Figure 14:
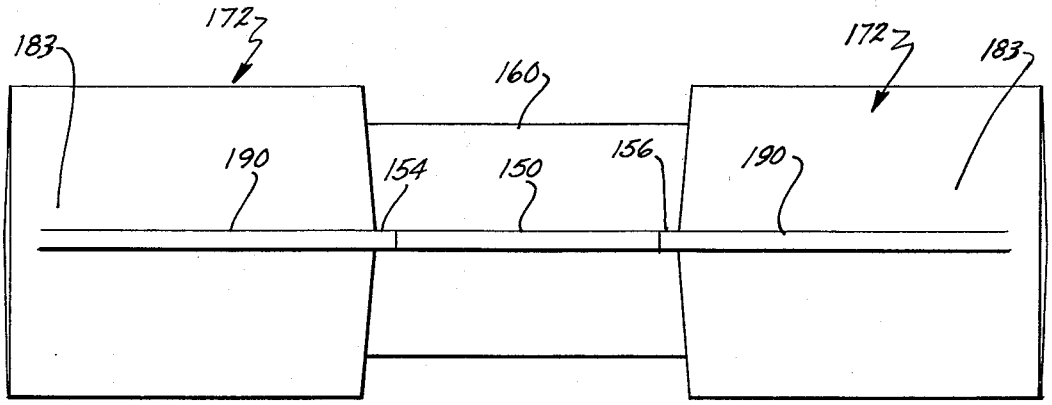
FIG. 14 is a bottom plan view of the connector of FIG. 12.

As best seen in FIG. 12, with the connector embodiment 22', the hood portion of the ventilator section, is received within the ventilator slots 176, the ventilator panel portion is positioned above the portions 168 of the outer flange 158 and the flashing portion 42 of the ventilator section is disposed below the flashing tabs 172. With the previously described embodiment, as seen in FIG. 3, the flashing portion 42 of the ventilator is disposed above the flashing tabs 98, 100 of that connector. When assembled to the ventilator section, the edges of the flashing portions of the ventilator abut against the ribs 190 of the preferred embodiment. This assures a relatively good seal between adjacent sections and the connector. Due to the beveling or tapering of the inner connector flange 160, the portions 166 and 172 of the outer connector flange 158, it is much easier for the installer to connect adjacent ventilator sections with the embodiment illustrated in FIGS. 13–17. As with the previous embodiment, due to the cutout the central top forms a flexible bridge. The connector, therefore, can be flexibly reshaped to adjust to roofs of a substantial range of pitch without significant distortion of the connector on each side of the web 150.

In assembling the roof ridge ventilator system, a suitable liquid or semi-liquid sealant and bonding agent or other like compound may be employed in conjunction with the connectors 22 or 22' of the subject invention to further insure a moisture proof seal at each joint.

It will be readily appreciated that connectors in accordance with the present invention may have an outline which differs from that illustrated in the drawings. The important factor, however, is to provide a connector having the same general outline as each ridge vent section and an inner sleeve and outer jacket to receive and overlap the ends of each ventilator section. It must also be capable of substantial deflection without distortion of its ventilator engaging portions so it will at all times be capable of being easily slipped onto the end of a ventilator section.

The cutout portion of each connector wall results in communication between each roof ridge ventilator section thereby increasing the efficiency of the overall natural attic ventilation arrangement. The deflectable wall including the depression and bulge formed on the end cap permit the overall assembly to adapt to roofs of different pitches. The end caps and connectors permit ready assembly of the roof ridge ventilator at a construction site and alleviate the need for separate cover elements to accommodate each particular roof pitch. Further, the end caps and connectors are easily moldable by high speed automatic equipment permitting use of relatively low cost mass production manufacturing techniques.

Thus, it will be appreciated that the present invention provides a connector or joiner arrangement which results in a moisture proof connection between roof ridge ventilator sections. The connectors are easily manufactured and readily adaptable to ventilator assemblies for different roof pitches. It is expressly intended, therefore, that the foregoing description is illustrative of the preferred embodiment only and is not to be considered limiting. The true spirit and scope of the present invention will be determined by reference to the appended claims.

The embodiments of the invention in which an exclusive property or privilege is claimed are defined as follows.

1. A connector for joining sections of a generally T-shaped roof ridge ventilator, said connector having a generally T-shape and including a leg and comprising: a central T-shaped planar web portion and a pair of spaced generally parallel flanges projecting laterally from each face of said web, said flanges defining a narrow, ventilator end receiving slot therebetween; the central portion of said web including parts of the leg of said T-shaped connector being cutaway to define an open portion having sides and to form a part of the central top portion of said connector into a flexible bridge and the length of said open portion being so related to the height of said T-shaped web portion that said connector can be flexibly reshaped to adjust to roofs of a substantial range of pitches without significant distortion of said connector slot on each side of said web.

2. A connector as described in claim 1 wherein a flange-like skirt extends from each face of said web along the sides of said open portion.

3. A connector as described in claim 2 wherein the lower end of said skirt extends generally downwardly and laterally to form laterally projecting flashing legs.

4. A connector as described in claim 3 wherein one of said parallel flanges has a transverse width less than the other of said flanges along a portion of its length.

5. A connector as described in claim 4 wherein said one of said flanges includes a peaked top portion, side portions and inwardly directed portions integral with the lower ends of said side portions, each of said inwardly directed portions having a generally truncated triangular shape in plan.

6. A connector as described in claim 5 wherein said laterally projecting flashing legs increase in thickness from their lateral edges to their longitudinal center lines so that their undersurfaces are beveled.

7. A connector as described in claim 6 further including a sealing rib extending longitudinally along the undersurface of each of said flashing legs.

8. A connector as defined by claim 7 wherein said other of said flanges is beveled along its upper surface so that said receiving slot opens outwardly.

9. A connector as defined by claim 8 wherein the upper surfaces of said inwardly directed portions are beveled to increase the ease of assembly to a ventilator section.

10. A connector for joining adjacent ventilator sections, each section being of the type including a hood portion, integral side wall portions, panel portions and outwardly extending, downwardly angled flashing portions, said connector comprising:

an intermediate planar web having a centrally cutout wall portion having a main section and depending leg sections, said connector wall being shaped to conform to the general cross-section of said ventilator section;

an outer connector jacket longitudinally directed laterally from each side of said intermediate web relative to said ventilator sections and extending around the periphery of said wall; and an inner connector sleeve spaced from and extending laterally from each side of said web in parallel relationship with said outer connector jacket, said inner connector sleeves extending adjacent at least a portion of said outer connector jacket to thereby define slots to sealingly receive and connect the ends of adjacent ventilator sections and the length of said central cutout being so related to the vertical height of said intermediate web that each connector is capable of flexing about said main section without significant distortion of said connector slots on each side of said intermediate web.

11. A connector as defined by claim 10 further including upstanding inner jackets extending vertically along the inner edge of the leg portions of said intermediate wall portion, said outer connector jacket extending down a portion of the outer lateral edge of said leg portion; and flashing legs extending outwardly and downwardly from said upstanding inner jackets and said leg portions of said intermediate wall.

12. A connector as defined by claim 10 wherein said outer connector jacket includes inwardly directed, generally horizontal portions adapted to engage the underside of said panel portion of said ventilator section and wherein said outer connector jacket has a transverse width less than the transverse width of said inner sleeve.

13. A connector as defined by claim 12 wherein said inner sleeve has an upper surface beveled so that the slot opening increases longitudinally from said intermediate wall.

14. A connector as defined by claim 13 wherein said inwardly directed portions of said outer connector jacket have a truncated, triangular shape in plan and the upper surfaces thereof are beveled transversely of said intermediate wall.

15. A connector as defined in claim 14 wherein said outer connector jacket extends down said depending leg portions and then extends outwardly and downwardly to define flashing portions.

16. A connector as defined by claim 15 further including a sealing rib extending longitudinally of each of said flashing portions along the underside thereof.

17. A connector as defined by claim 16 wherein the undersurface of each of said flashing portion is beveled from the lateral edges thereof to the longitudinal center line thereof.

* * * * *